US012757988B2

(12) United States Patent
Guo

(10) Patent No.: US 12,757,988 B2
(45) Date of Patent: Oct. 13, 2026

(54) CARD HOLDER WALLET

(71) Applicant: Chucan Guo, Guangzhou (CN)

(72) Inventor: Chucan Guo, Guangzhou (CN)

( * ) Notice: Subject to any disclaimer, the term of this patent is extended or adjusted under 35 U.S.C. 154(b) by 0 days.

(21) Appl. No.: 19/387,878

(22) Filed: Nov. 13, 2025

(65) Prior Publication Data

US 2026/0069007 A1 Mar. 12, 2026

Related U.S. Application Data

(63) Continuation-in-part of application No. 18/822,988, filed on Sep. 3, 2024, now abandoned.

(51) Int. Cl.
*A45C 1/06* (2006.01)

(52) U.S. Cl.
CPC ..... *A45C 1/06* (2013.01); *A45C 2001/065* (2013.01); *A45C 2001/067* (2013.01)

(58) Field of Classification Search
CPC ..... A45C 1/06; A45C 2001/065; A45C 2001/067; A45C 11/182
USPC ..... 150/147
See application file for complete search history.

(56) References Cited

U.S. PATENT DOCUMENTS 3,970,129 A * 7/1976 Tepfer ..... A45C 11/18 150/900
2013/0276943 A1* 10/2013 Minn ..... A45C 1/06 150/137
2015/0083289 A1* 3/2015 Johnson ..... A45C 1/06 150/144
2017/0035169 A1* 2/2017 Haarburger ..... A45C 1/06
2020/0138157 A1* 5/2020 Adelman ..... A45C 11/182
2021/0112935 A1* 4/2021 Tran ..... B25F 1/006
2021/0337945 A1* 11/2021 Popoff ..... A45C 13/1069
2023/0189949 A1* 6/2023 Kane ..... A45C 11/182 150/147

FOREIGN PATENT DOCUMENTS

CN 219438403 U * 8/2023 ..... A45C 11/182
CN 219953845 U * 11/2023 ..... A45F 5/155

* cited by examiner

*Primary Examiner* — Nathan J Jenness
*Assistant Examiner* — Justin Caudill
(74) *Attorney, Agent, or Firm* — JEEN IP LAW, LLC

(57) ABSTRACT

A novel card holder wallet is provided, including a first panel, a second panel, and elastic bands. The first panel and the second panel are arranged opposite to each other. A first connecting portion is arranged at a lateral edge of the first panel, a second connecting portion is arranged at a lateral edge of the second panel, and the first connecting portion and the second connecting portion are arranged opposite to each other. The lateral edge of the first panel at least includes a first upper lateral edge and a second upper lateral edge, the first connecting portion includes a first upper connecting portion and a second upper connecting portion, the first upper connecting portion is arranged on the first upper lateral edge, and the second upper connecting portion is arranged on the second upper lateral edge.

18 Claims, 8 Drawing Sheets

CARD HOLDER WALLET

TECHNICAL FIELD

The present disclosure relates to the field of card holder wallets, and particularly, to a novel card holder wallet.

BACKGROUND

With the popularity of mobile payment, people rarely carry lots of cash when going out. They usually only carry a small amount of cash and a few of necessary cards such as a bank card, a membership card, a shopping card, and an entrance guard card. Therefore, the frequency of use of a traditional wallet has greatly decreased. Portable card holder wallets have emerged, which are mainly configured to store cards and accommodate a small amount of cash. A portable card holder wallet in the prior art typically includes a first panel and a second panel. The two panels are connected by a hinge structure, so that they can rotate relative to each other to be opened, to store cards. However, this structure is relatively complex and not conducive to the production of card holder wallets.

SUMMARY

To solve the shortcomings in the prior art, the present disclosure provides a novel card holder wallet.

The technical solution used in the present disclosure to solve the technical problems is as follows.

The present disclosure provides a first embodiment of a novel card holder wallet, including a first panel, a second panel, and elastic bands. The first panel and the second panel are arranged opposite to each other. A first connecting portion is arranged at a lateral edge of the first panel, a second connecting portion is arranged at a lateral edge of the second panel, and the first connecting portion and the second connecting portion are arranged opposite to each other. The lateral edge of the first panel at least includes a first upper lateral edge and a second upper lateral edge, the first connecting portion includes a first upper connecting portion and a second upper connecting portion, the first upper connecting portion is arranged on the first upper lateral edge, and the second upper connecting portion is arranged on the second upper lateral edge. The lateral edge of the second panel at least includes a first lower lateral edge and a second lower lateral edge, the second connecting portion includes a first lower connecting portion and a second lower connecting portion, the first lower connecting portion is arranged on the first lower lateral edge, and the second lower connecting portion is arranged on the second lower lateral edge. The first upper connecting portion and the first lower connecting portion are arranged opposite to each other, and the second upper connecting portion and the second lower connecting portion are arranged opposite to each other. The elastic bands include a first elastic band and a second elastic band, the first elastic band is arranged around an outer surface of the first upper connecting portion and an outer surface of the first lower connecting portion, and the second elastic band is arranged around an outer surface of the second upper connecting portion and an outer surface of the second lower connecting portion, so that the first connecting portion is elastically connected to the second connecting portion. In the first panel, the first upper lateral edge and the second upper lateral edge are adjacent sides, and correspondingly, in the second panel, the first lower lateral edge and the second lower lateral edge are adjacent sides.

Furthermore, the first connecting portion and the second connecting portion are both provided with limiting slots to respectively limit the elastic bands.

Furthermore, a height of each of the limiting slots is not less than one-fifth of a height of a corresponding one of the elastic bands, or not less than one-third of the height of the corresponding one of the elastic bands, or not less than one-half of the height of the corresponding one of the elastic bands, or not less than the corresponding one of the elastic bands.

Furthermore, the first upper connecting portion at least includes two first upper end slots respectively at two ends thereof, the first lower connecting portion at least includes two first lower end slots respectively at two ends thereof, the two first upper end slots and the two first lower end slots are arranged opposite to each other, and the first elastic band is limited within the two first upper end slots and the two first lower end slots. The second upper connecting portion at least includes two second upper end slots respectively at two ends thereof, the second lower connecting portion at least includes two second lower end slots respectively at two ends thereof, the two second upper end slots and the two second lower end slots are arranged opposite to each other, and the second elastic band is limited within the two second upper end slots and the two second lower end slots.

Furthermore, a height of each of the two first upper end slots and a height of each of the two first lower end slots are not less than one-fifth of a height of the first elastic band. A height of each of the two second upper end slots and a height of each of the two second lower end slots are not less than one-fifth of a height of the second elastic band.

Furthermore, the height of each of the two first upper end slots and the height of each of the two first lower end slots are not less than one-third of the height of the first elastic band. The height of each of the two second upper end slots and the height of each of the two second lower end slots are not less than one-third of the height of the second elastic band.

Furthermore, the height of each of the two first upper end slots and the height of each of the two first lower end slots are not less than one-half of the height of the first elastic band. The height of each of the two second upper end slots and the height of each of the two second lower end slots are not less than one-half of the height of the second elastic band.

Furthermore, the height of each of the two first upper end slots and the height of each of the two first lower end slots are not less than the height of the first elastic band. The height of each of the two second upper end slots and the height of each of the two second lower end slots are not less than the height of the second elastic band.

Furthermore, the first upper connecting portion further includes a first upper transverse slot for communicating the two first upper end slots at the two ends thereof, the first lower connecting portion further includes a first lower transverse slot for communicating the two first lower end slots at the two ends thereof, and the first elastic band is limited within the first upper transverse slot and the first lower transverse slot. The second upper connecting portion further includes a second upper transverse slot for communicating the two second upper end slots at the two ends thereof, the second lower connecting portion further includes a second lower transverse slot for communicating the two second lower end slots at the two ends thereof, and the second elastic band is limited within the second upper transverse slot and the second lower transverse slot.

Furthermore, a height of the first upper transverse slot and a height of the first lower transverse slot are not less than one-fifth of the height of the first elastic band. A height of the second upper transverse slot and a height of the second lower transverse slot are not less than one-fifth of the height of the second elastic band.

Furthermore, the height of the first upper transverse slot and the height of the first lower transverse slot are not less than one-third of the height of the first elastic band. The height of the second upper transverse slot and the height of the second lower transverse slot are not less than one-third of the height of the second elastic band.

Furthermore, the height of the first upper transverse slot and the height of the first lower transverse slot are not less than one-half of the height of the first elastic band. The height of the second upper transverse slot and the height of the second lower transverse slot are not less than one-half of the height of the second elastic band.

Furthermore, the height of the first upper transverse slot and the height of the first lower transverse slot are not less than the height of the first elastic band. The height of the second upper transverse slot and the height of the second lower transverse slot are not less than the height of the second elastic band.

Furthermore, the lateral edge of the first panel further includes a third upper lateral edge and a fourth upper lateral edge, and the lateral edge of the second panel further includes a third lower lateral edge and a fourth lower lateral edge. An insertion port is formed between the third upper lateral edge, the fourth upper lateral edge, the third lower lateral edge, and the fourth lower lateral edge. Anti-detachment buckles are arranged at the insertion port.

Furthermore, the anti-detachment buckles are elastic buckles and are respectively arranged on at least the third upper lateral edge and the fourth upper lateral edge, and/or the third lower lateral edge and the fourth lower lateral edge.

Furthermore, when the anti-detachment buckles are respectively arranged on the third upper lateral edge and the fourth upper lateral edge, each of the third upper lateral edge and the fourth upper lateral edge is provided with an accommodating slot. Each of the anti-detachment buckles includes an elastic arm, an elastic connecting portion, and a hook portion, each elastic connecting portion is arranged at a first end of a corresponding elastic arm and is connected to a side wall of the accommodating slot distal from an outer side of a corresponding one of the third upper lateral edge and the fourth upper lateral edge, each hook portion is arranged at a second end of a corresponding elastic arm, a retraction space is provided between each elastic arm and the accommodating slot of a corresponding one of the third upper lateral edge and the fourth upper lateral edge.

Furthermore, an arc-shaped guiding surface is provided between each hook portion and a corresponding elastic arm.

Furthermore, each elastic connecting portion and the side wall of the accommodating slot distal from the outer side of the corresponding one of the third upper lateral edge and the fourth upper lateral edge are integrally formed.

The present disclosure further provides a second embodiment of a novel card holder wallet, including a first panel, a second panel, and elastic bands. The first panel and the second panel are arranged opposite to each other. A first connecting portion is arranged at a lateral edge of the first panel, a second connecting portion is arranged at a lateral edge of the second panel, and the first connecting portion and the second connecting portion are arranged opposite to each other. The lateral edge of the first panel at least includes a first upper lateral edge and a second upper lateral edge, the first connecting portion includes a first upper connecting portion and a second upper connecting portion, the first upper connecting portion is arranged on the first upper lateral edge, and the second upper connecting portion is arranged on the second upper lateral edge. The lateral edge of the second panel at least includes a first lower lateral edge and a second lower lateral edge, the second connecting portion includes a first lower connecting portion and a second lower connecting portion, the first lower connecting portion is arranged on the first lower lateral edge, and the second lower connecting portion is arranged on the second lower lateral edge. The first upper connecting portion and the first lower connecting portion are arranged opposite to each other, and the second upper connecting portion and the second lower connecting portion are arranged opposite to each other. The elastic bands include a first elastic band and a second elastic band, the first elastic band is detachably arranged around an outer surface of the first upper connecting portion and an outer surface of the first lower connecting portion, and the second elastic band is detachably arranged around an outer surface of the second upper connecting portion and an outer surface of the second lower connecting portion, so that the first connecting portion is elastically connected to the second connecting portion. In the first panel, the first upper lateral edge and the second upper lateral edge are adjacent sides, and correspondingly, in the second panel, the first lower lateral edge and the second lower lateral edge are adjacent sides.

Furthermore, when in a use state, only a junction of the first upper lateral edge and the second upper lateral edge abuts against a junction of the first lower lateral edge and the second lower lateral edge to define the insertion port. The lateral edge of the first panel further includes the third upper lateral edge and the fourth upper lateral edge, and the lateral edge of the second panel further includes the third lower lateral edge and the fourth lower lateral edge, and the insertion port is formed between the third upper lateral edge, the fourth upper lateral edge, the third lower lateral edge, and the fourth lower lateral edge.

Beneficial effects of the present disclosure are as follows.

Through the above structural arrangement, the elastic bands are respectively arranged around an outer surface of the first connecting portion and an outer surface of the second connecting portion, so that the first connecting portion and the second connecting portion are elastically connected to each other, enabling the first panel and the second panel to be elastically connected to each other. During use, storage of cards and other items can be achieved by elastically opening the first panel and the second panel, and placing the cards and other items between the first panel and the second panel. The structure is simple and easy to use and assemble. Moreover, due to the elastic connection between the first panel and the second panel, the first panel and the second panel can further apply elastic clamping force to the inserted cards and items, ensuring that the cards can be stably stored in the card holder wallet, and effectively improving the reliability of the product. Meanwhile, the first connecting portion and the second connecting portion are arranged at the lateral edges of the first panel and the second panel, so that the elastic bands respectively on the first connecting portion and the second connecting portion will not affect the storage of the cards, and the structural design is appropriate and clever.

BRIEF DESCRIPTION OF THE DRAWINGS

To describe the technical solutions in the embodiments of the present disclosure more clearly, the following briefly introduces the accompanying drawings for describing the embodiments. The accompanying drawings in the following description show merely some embodiments of the present utility model, and a person of ordinary skill in the art may still derive other drawings from the accompanying drawings without creative efforts.

The present disclosure will be further explained below in conjunction with the accompanying drawings and embodiments.

DETAILED DESCRIPTION OF THE EMBODIMENTS

Figure 1:
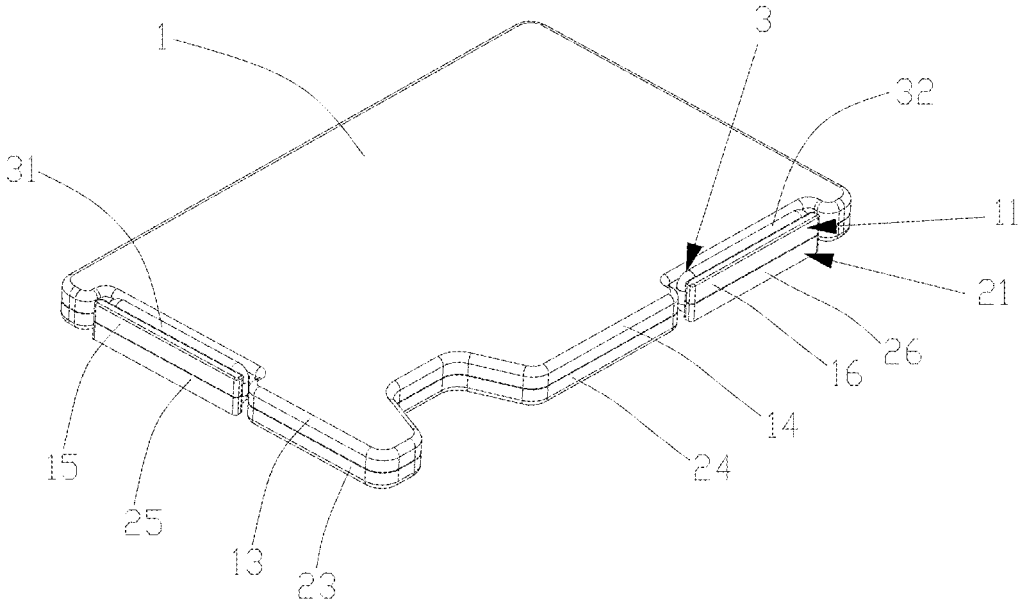
FIG. 1 is a structural schematic diagram of a card holder wallet according to one embodiment of the present disclosure.
Figure 2:
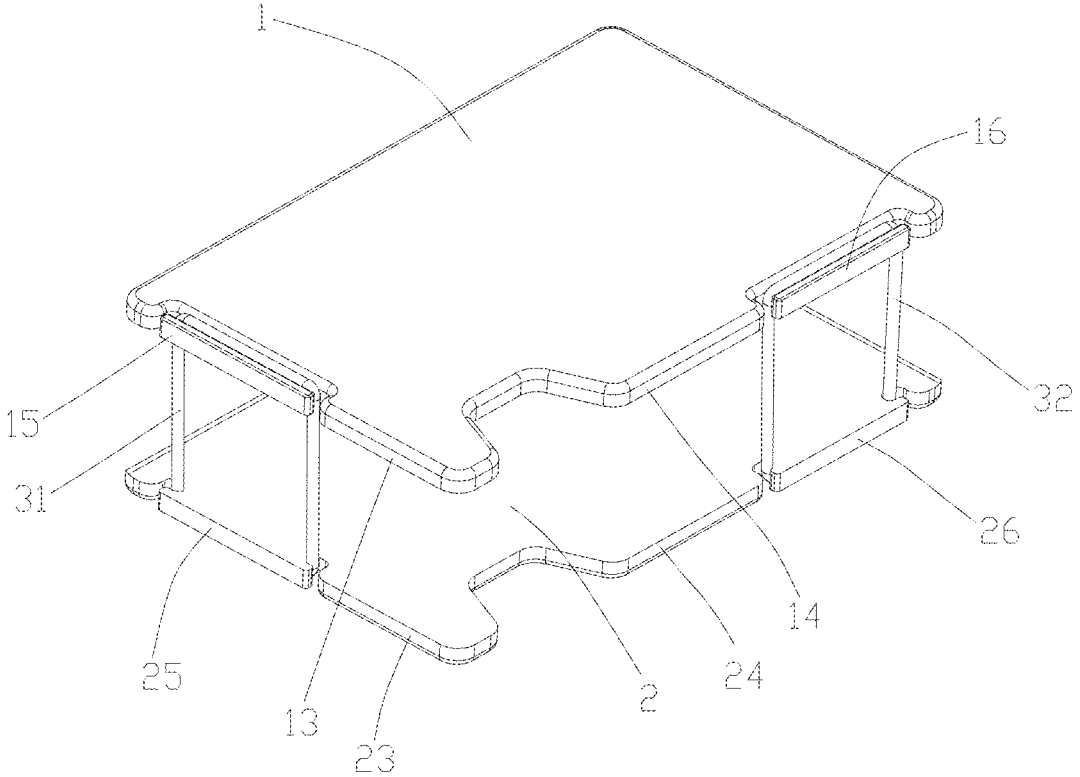
FIG. 2 is a schematic diagram of an opened state of a card holder wallet.
Figure 3:
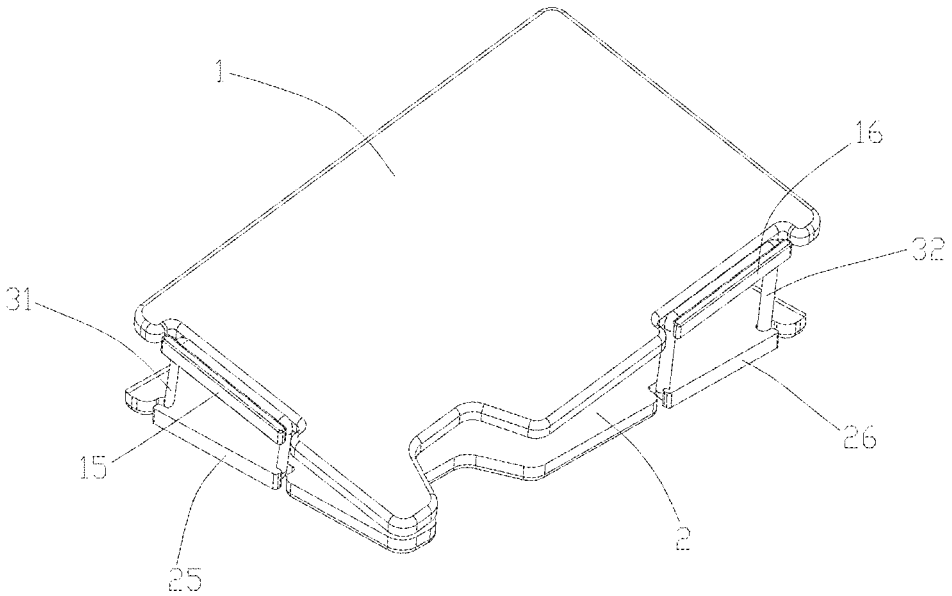
FIG. 3 is a schematic diagram of another opened state of a card holder wallet, to show a state of a lateral edge where the elastic band is located.
Figure 4:
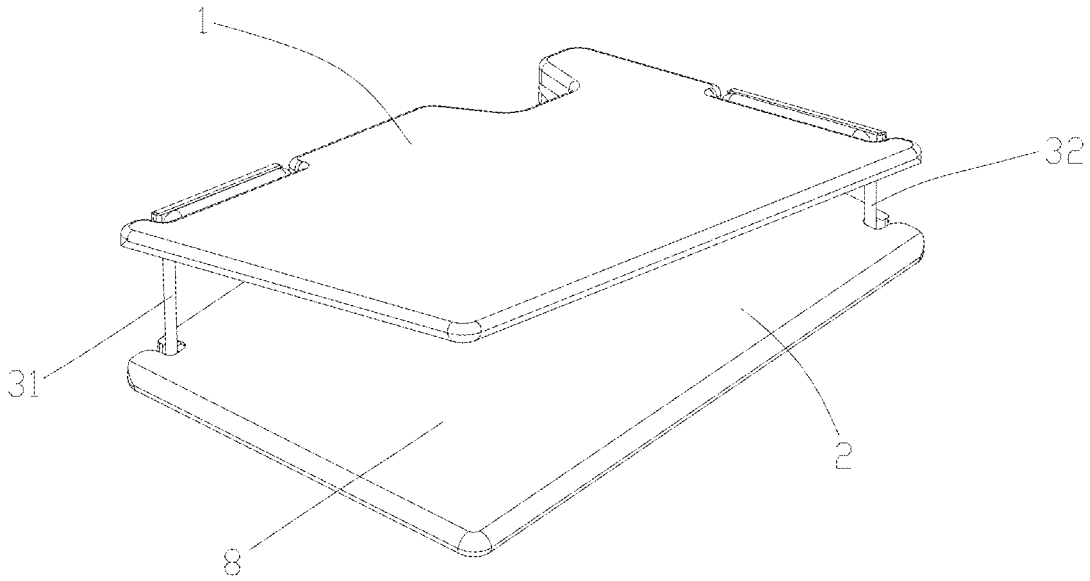
FIG. 4 is a schematic diagram of another opened state of a card holder wallet, to show a state of an insertion port.
Figure 5:
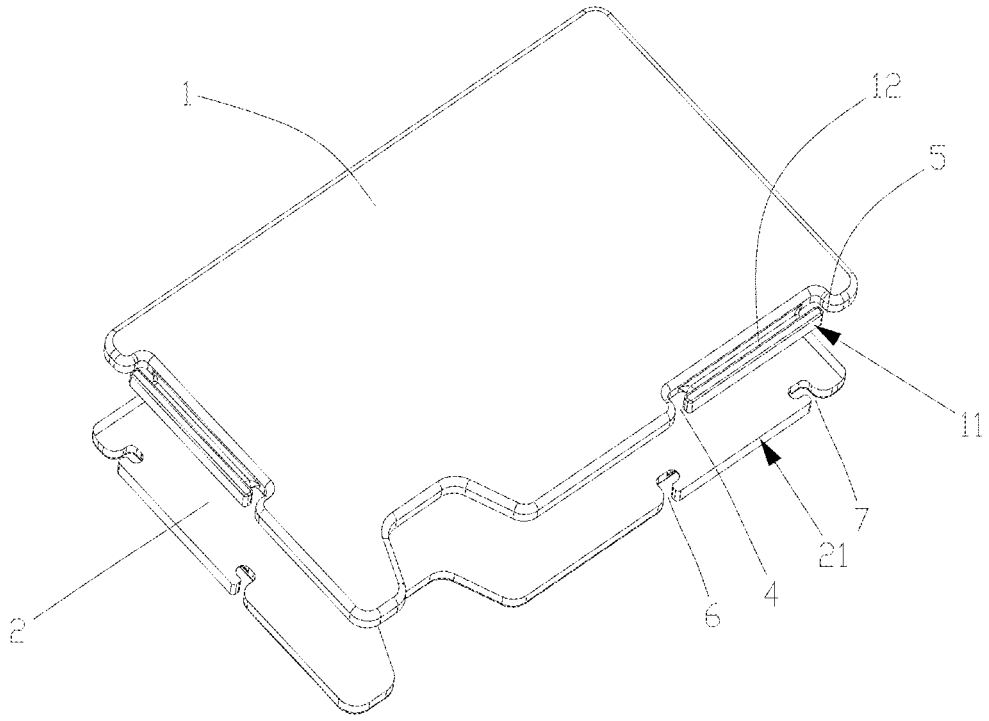
FIG. 5 is an exploded diagram of a card holder wallet, to show limiting slots of a first panel, where elastic bands are omitted.
Figure 6:
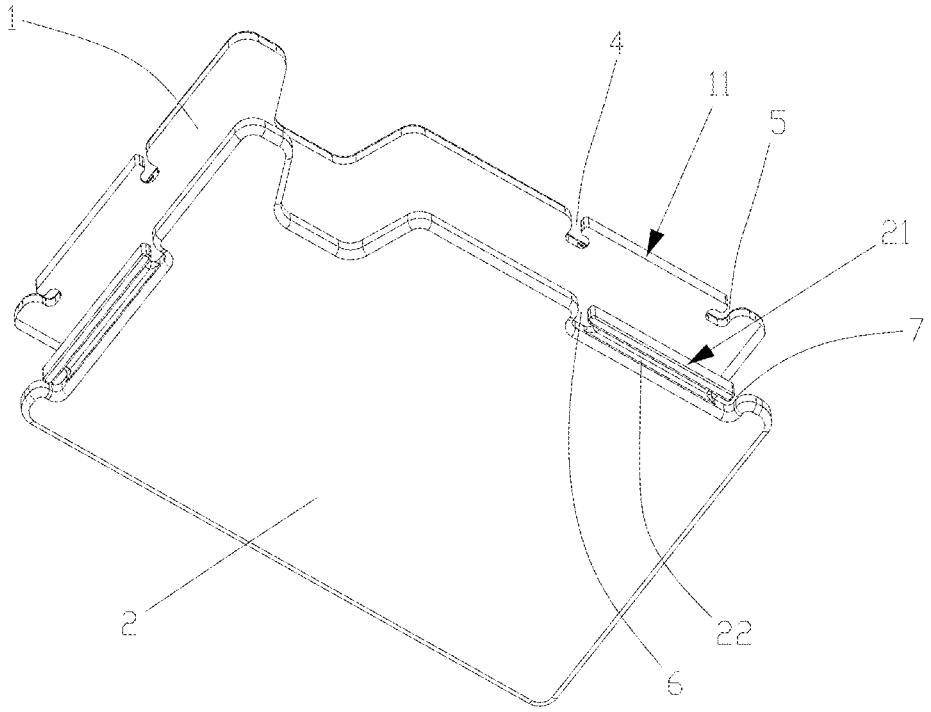
FIG. 6 is an exploded diagram of a card holder wallet, to show limiting slots of a second panel, where elastic bands are omitted.
Figure 7:
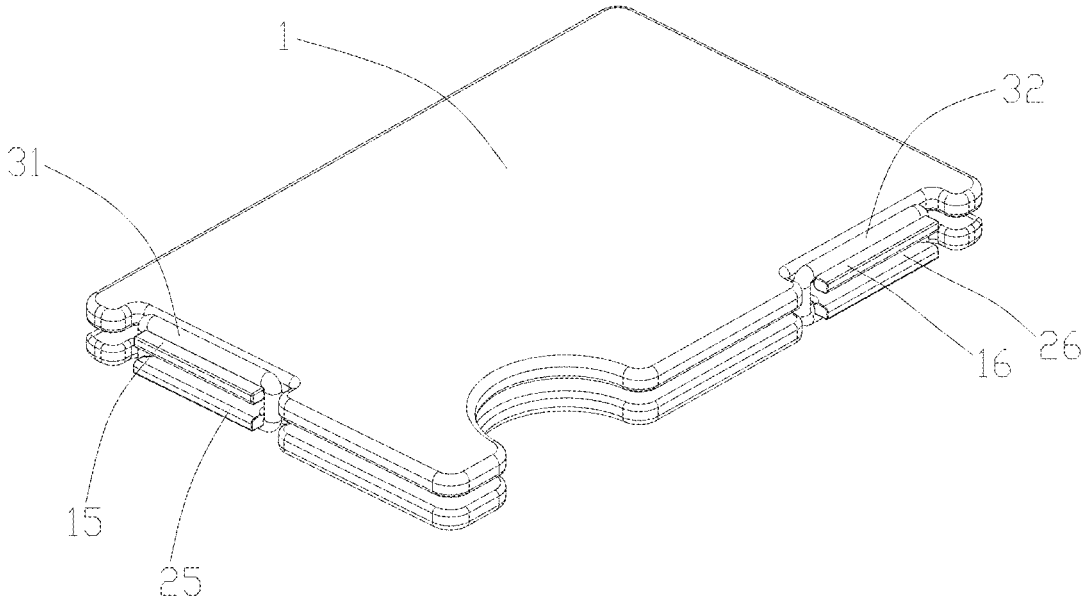
FIG. 7 is a structural schematic diagram of the card holder wallet according to one embodiment of the present disclosure.
Figure 8:
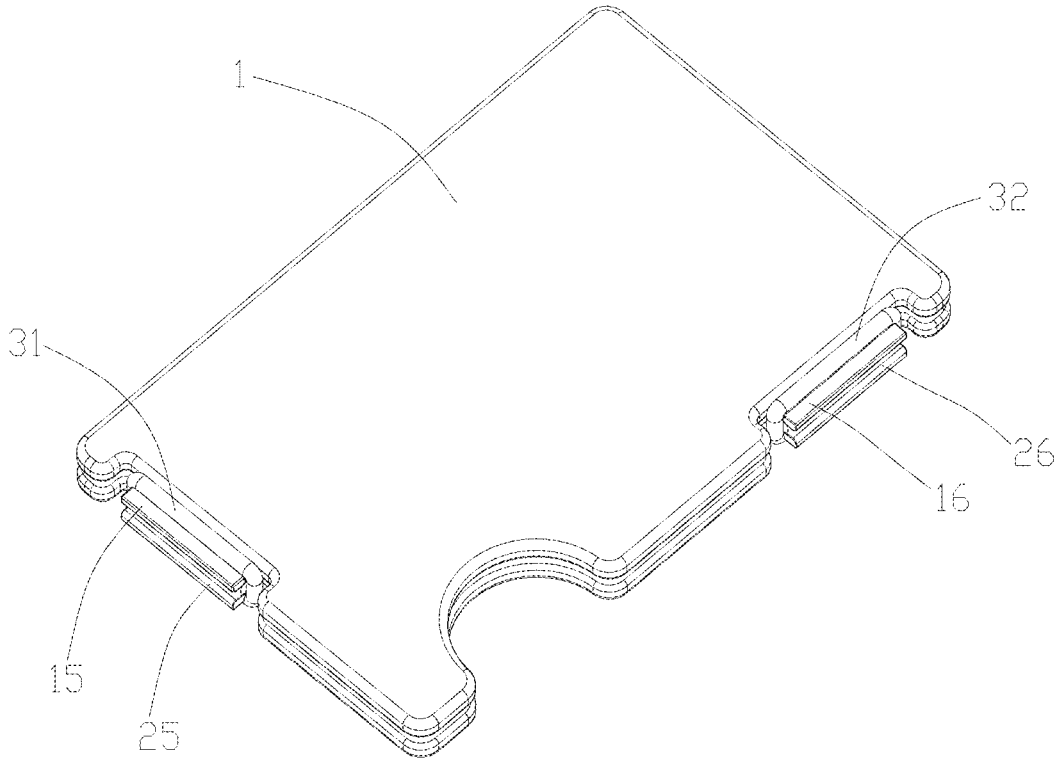
FIG. 8 is a structural schematic diagram of the card holder wallet according to another embodiment of the present disclosure.
Figure 9:
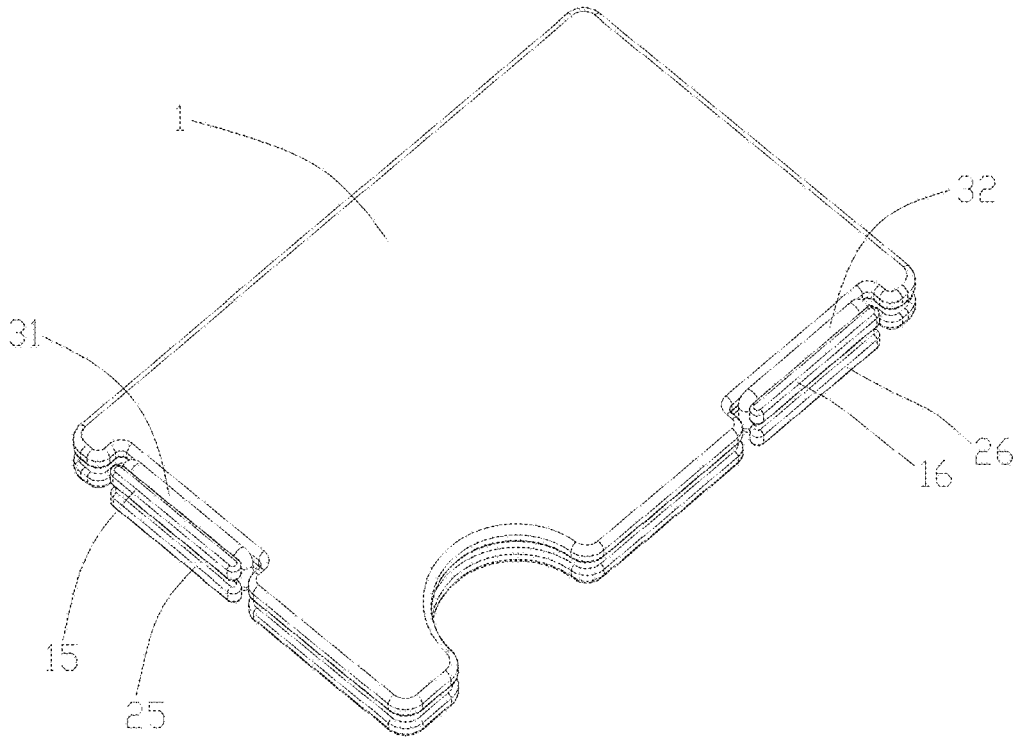
FIG. 9 is a structural schematic diagram of the card holder wallet according to another embodiment of the present disclosure.
Figure 10:
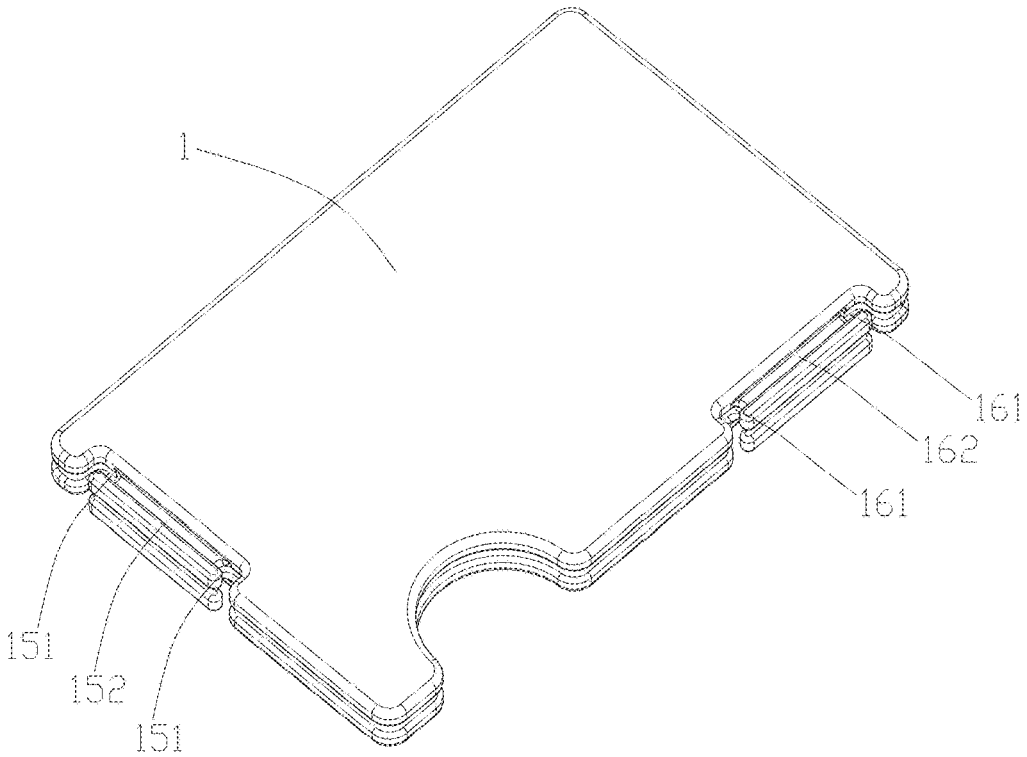
FIG. 10 is a structural schematic diagram of the card holder wallet shown in FIG. 9, where a first elastic band and a second elastic band are omitted.
Figure 11:
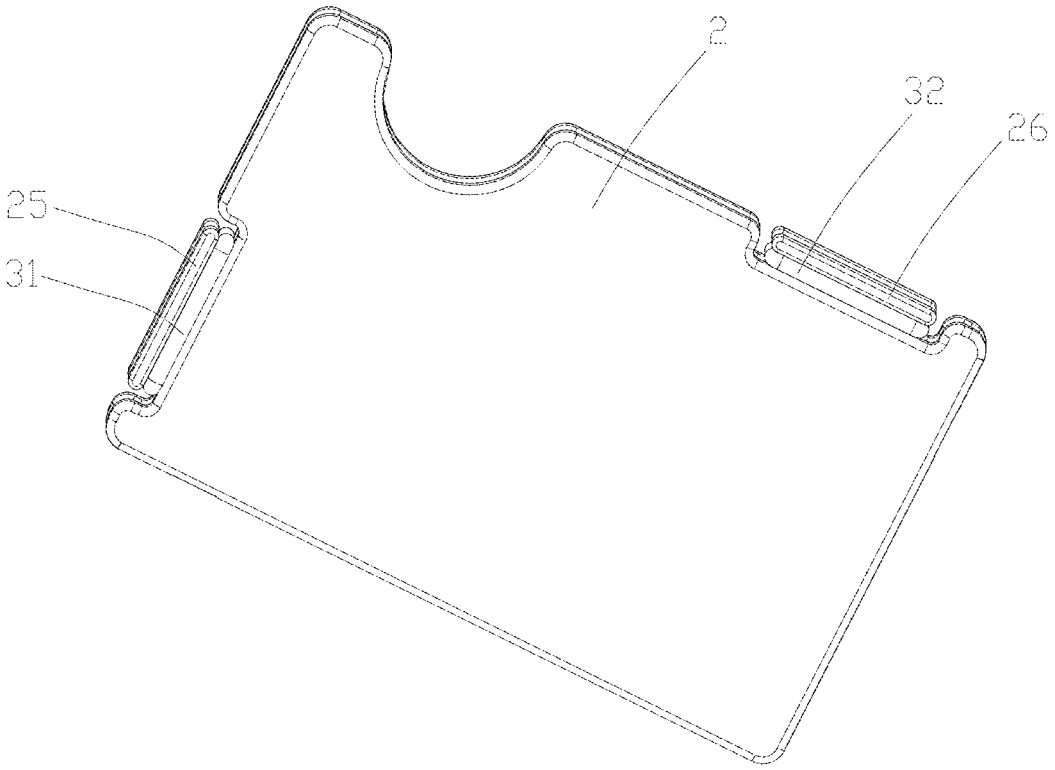
FIG. 11 is another structural schematic diagram of the card holder wallet shown in FIG. 9.
Figure 12:
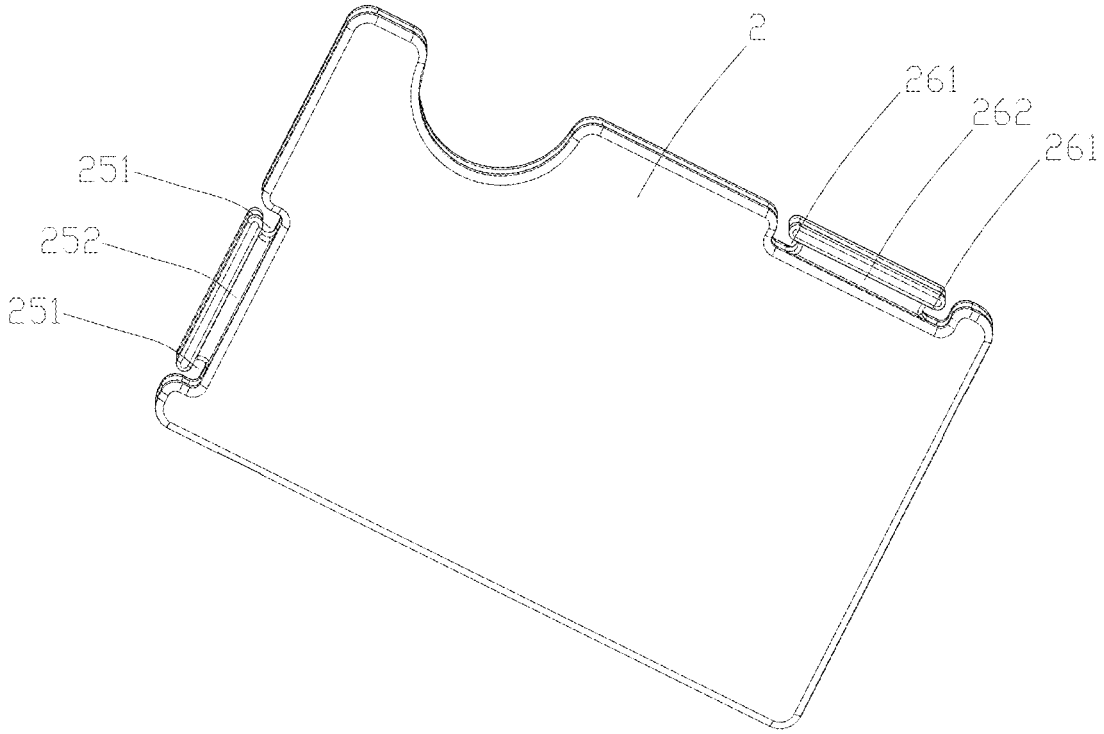
FIG. 12 is a structural schematic diagram of the card holder wallet shown in FIG. 11, where the first elastic band and the second elastic band are omitted.
Figure 13:
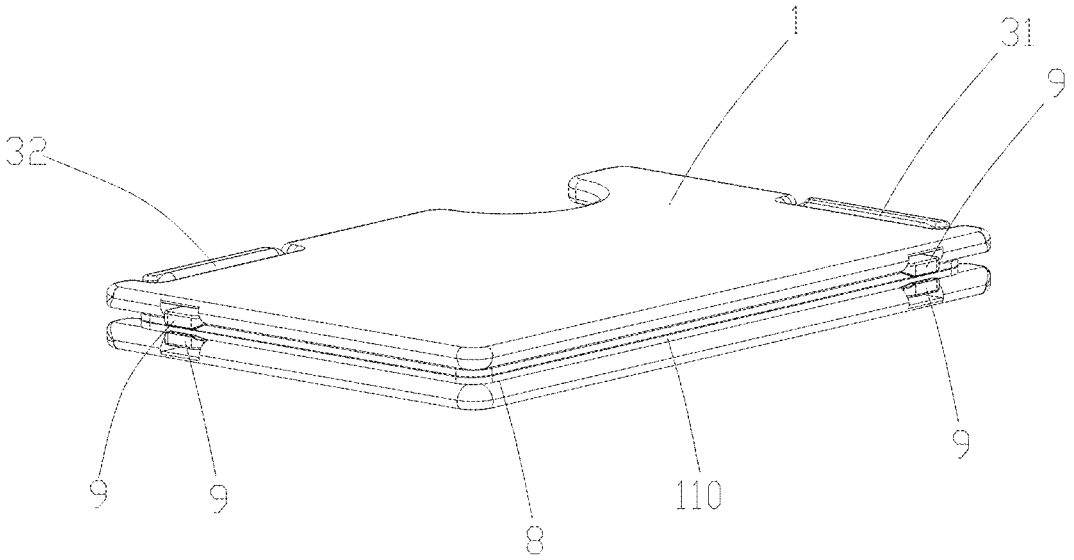
FIG. 13 a structural schematic diagram of the card holder wallet according to another embodiment of the present disclosure, to show a use state of anti-detachment buckles.
Figure 14:
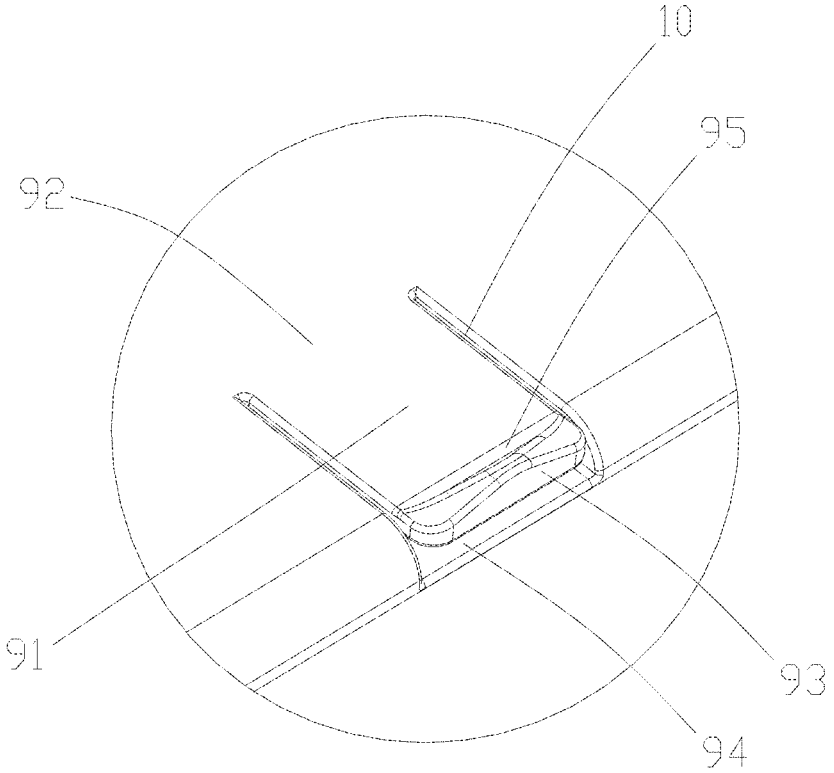
FIG. 14 is a structural schematic diagram of one of the anti-detachment buckles.
Figure 15:
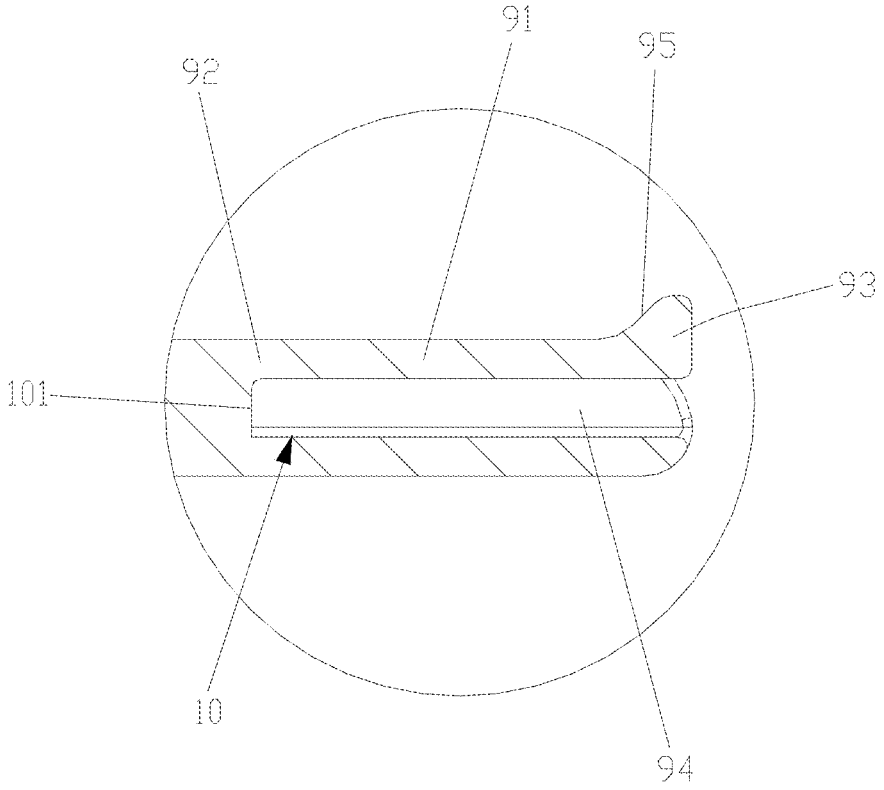
FIG. 15 is a cross-sectional schematic diagram of one of the anti-detachment buckles.

Referring to FIG. 1 to FIG. 15, a novel card holder wallet includes a first panel 1, a second panel 2, and elastic bands 3. The first panel 1 and the second panel 2 are arranged opposite to each other; a first connecting portion 11 is arranged at a lateral edge of the first panel 1; a second connecting portion 21 is arranged at a lateral edge of the second panel 2; the first connecting portion 11 and the second connecting portion 21 are arranged opposite to each other; and the elastic bands 3 are respectively arranged around an outer surface of the first connecting portion 11 and an outer surface of the second connecting portion 21, so that the first connecting portion 11 is elastically connected to the second connecting portion 21.

Through the above structural arrangement, the elastic bands are arranged around the outer surface of the first connecting portion 11 and the outer surface of the second connecting portion 21, so that the first connecting portion 11 and the second connecting portion 21 are elastically connected to each other, enabling the first panel 1 and the second panel 2 to be elastically connected to each other. During use, storage of cards and other items can be achieved by elastically opening the first panel 1 and the second panel 2, and placing the cards and other items between the first panel 1 and the second panel 2. The structure is simple and easy to use and assemble. Moreover, due to the elastic connection between the first panel 1 and the second panel 2, the first panel 1 and the second panel 2 can further apply elastic clamping force to the inserted cards and items, ensuring that the cards can be stably stored in the card holder wallet, and effectively improving the reliability of the product. Meanwhile, the first connecting portion 11 and the second connecting portion 21 are arranged at the lateral edges, so that the elastic bands respectively on the first connecting portion 11 and the second connecting portion 21 will not affect the storage of the cards, and the structural design is appropriate and clever.

In this embodiment, the first connecting portion 12 and the second connecting portion 22 are both provided with a first limiting portion 12 and a second limiting portion 22 to respectively limit the elastic bands.

Specifically, the first limiting portion 12 and the second limiting portion 22 are both limiting slots, so that slot walls of the limiting slots can be formed as the outer surface of the first connecting portion 11 and the outer surface of the second connecting portion 21. Namely, the limiting slots include first limiting slots and second limiting slots, the first limiting slots are provided at a top and two sides of the first connecting portion 11, and the second limiting slots are provided at a bottom and two sides of the second connecting portion 21, so that the elastic bands 3 can respectively completely fall into the limiting slots to achieve the surrounding arrangement, which can effectively limit the elastic bands 3 from being separated from the first connecting portion 11 and the second connecting portion 21. The structure is simple, stable, and reliable. As a preference, a height of each of the limiting slots is not less than the height of a corresponding one of the elastic bands 3, which can further ensure that the elastic band will not be separated from the limiting slots. The structure is simple, stable, and reliable.

Specifically, the height of each of the limiting slots is not less than one-fifth of a height of a corresponding one of the elastic bands 3, or not less than one-third of the height of the corresponding one of the elastic bands 3, or not less than one-half of the height of the corresponding one of the elastic bands 3, or not less than the corresponding one of the elastic bands 3.

In this embodiment, the lateral edge of the first panel 1 at least includes a first upper lateral edge 13 and a second upper lateral edge 14, the first connecting portion 11 includes a first upper connecting portion 15 and a second upper connecting portion 16, the first upper connecting portion 15 is arranged on the first upper lateral edge 13, and the second upper connecting portion 16 is arranged on the second upper lateral edge 14. Correspondingly, the lateral edge of the second panel 2 at least includes a first lower lateral edge 23 and a second lower lateral edge 24, the second connecting portion 21 includes a first lower connecting portion 25 and a second lower connecting portion 26, the first lower connecting portion 25 is arranged on the first lower lateral edge 23, the second lower connecting portion 26 is arranged on the second lower lateral edge 24, the first upper connecting portion 15 and the first lower connecting portion 25 are arranged opposite to each other, and the second upper connecting portion 16 and the second lower connecting portion 26 are arranged opposite to each other. The elastic bands 3 includes a first elastic band 31 and a second elastic band 32, the first elastic band 31 is arranged around an outer surface of the first upper connecting portion 15 and an outer surface of the first lower connecting portion 25, and the second elastic band 32 is arranged around an outer surface of the second upper connecting portion 16 and an outer surface of the second lower connecting portion 26. Through the above structural arrangement, the card holder wallet can be formed into a structure with at least two lateral edges that are elastically connected to each other, so that the elastic connection between the first panel 1 and the second panel 2 is more stable and reliable.

In the first panel 1, the first upper lateral edge 13 and the second upper lateral edge 14 are adjacent sides, and correspondingly, in the second panel 2, the first lower lateral edge 23 and the second lower lateral edge 24 are adjacent sides too. Through the above structural arrangement, a first lateral edge and a second lateral edge of the card holder wallet are adjacent to each other, and both the first lateral edge and the second lateral edge are elastically connected lateral edges. Remaining lateral edges (a third lateral edge and a fourth lateral edge) in the card holder wallet can be formed as an insertion port 8. When a card is inserted, the first panel 1 and the second panel 2 can form elastic opening points respectively at the elastically connected lateral edges (i.e., the first lateral edge and the second lateral edge), so that the first panel and the second panel can form an angle and are elastically opened. Namely, the insertion port 8 is elastically opened, thereby ensuring that the insertion port 8 can be fully opened to a sufficient angle for ease of fetching and placement of the card. The operation is very convenient. Of course, the first panel 1 and the second panel 2 can be elastically opened in a relatively parallel manner too, but the above mode is more convenient to operate.

In the first panel 1, the first upper lateral edge 13 and the second upper lateral edge 14 are opposite sides (not shown in the drawings), and correspondingly, in the second panel 2, the first lower lateral edge 23 and the second lower lateral edge 24 are opposite sides too (not shown in the drawings). Through the above structural arrangement, the first lateral edge and the second lateral edge of the card holder wallet are opposite to each other, and both the first lateral edge and the second lateral edge are elastically connected lateral edges. The remaining lateral edges (the third lateral edge and the fourth lateral edge) in the card holder wallet can be all formed as insertion ports 8. Namely, two insertion ports are provided, which is convenient for fetching and placing the card.

In the above structure, since the first connecting portion 11 includes the first upper connecting portion 15 and the second upper connecting portion 16, both the first upper connecting portion 15 and the second upper connecting portion 16 are provided with the first limiting slots to limit the elastic bands. Similarly, since the second connecting portion 21 includes the first lower connecting portion 25 and the second lower connecting portion 26, both the first lower connecting portion 25 and the second lower connecting portion 26 are provided with the second limiting slots to limit the elastic bands.

In this embodiment, the novel card holder wallet further includes a first partition slot 4 and a second partition slot 5, the first partition slot 4 extends towards the first panel 1 at the lateral edge of the first panel 1, the second partition slot 5 extends towards the first panel 1 at the lateral edge of the first panel 1, the first partition slot 4 and the second partition slot 5 are spaced apart from each other, and the first connecting portion 11 is formed between the first partition slot 4 and the second partition slot 5.

Further, the novel card holder wallet includes a third partition slot 6 and a fourth partition slot 7, the third partition slot 6 extends towards the second panel 2 at the lateral edge of the second panel 2, the fourth partition slot 7 extends towards the second panel 2 at the lateral edge of the second panel 2, the third partition slot 6 and the fourth partition slot 7 are spaced apart from each other, and the second connecting portion 21 is formed between the third partition slot 6 and the fourth partition slot 7. Through the above structural arrangement, the first panel 1 and the second panel 2 can be formed with the first connecting portion 11 and the second connecting portion 21 based on the shape of a card. The lateral edges of the first panel 1 and the second panel 2 will not have protrusions. Namely, the lateral edges of the card holder wallet will not have protrusion structures, which is convenient for carrying and using the card holder wallet. The structural design is appropriate and clever.

The first partition slot 4 and the third partition slot 6 are arranged opposite to each other, and the third partition slot 5 and the fourth partition slot 7 are arranged opposite to each other. The structure is simple, and the elastic band can be freely mounted and removed.

In the above structure, since the first connecting portion 11 includes the first upper connecting portion 15 and the second upper connecting portion 16, both the first upper connecting portion 15 and the second upper connecting portion 16 are formed between the partition slots. Similarly, since the second connecting portion 21 includes the first lower connecting portion 25 and the second lower connecting portion 26, both the first lower connecting portion 25 and the second lower connecting portion 26 are formed between the partition slots.

According to the novel card holder wallet, the first upper connecting portion 15 at least includes two first upper end slots 151 respectively at two ends thereof, the first lower connecting portion 25 at least includes two first lower end slots 251 respectively at two ends thereof, the two first upper end slots 151 and the two first lower end slots 251 are arranged opposite to each other, and the first elastic band 31 is limited within the two first upper end slots 151 and the two first lower end slots 251. The second upper connecting portion 16 at least includes two second upper end slots 161 respectively at two ends thereof, the second lower connecting portion 26 at least includes two second lower end slots 261 respectively at two ends thereof, the two second upper end slots 161 and the two second lower end slots 261 are arranged opposite to each other, and the second elastic band 32 is limited within the two second upper end slots 161 and the two second lower end slots 261. In an actual product, the two first upper end slots 151 and the two first lower end slots 251 are opposite in a vertical direction to effectively limit the first elastic band 31, ensuring that the first elastic band 31 is prevented from disengagement during relative displacement between the first panel 1 and the second panel 2. Similarly, the two second upper end slots 161 and the two second lower end slots 261 are opposite in the vertical direction to limit the second elastic band 32, ensuring that the second elastic band 32 is prevented from disengagement during relative displacement between the first panel 1 and the second panel 2.

Furthermore, the first upper connecting portion 15 further includes a first upper transverse slot 152 for communicating the two first upper end slots 151 at the two ends thereof, the first lower connecting portion 25 further includes a first lower transverse slot 252 for communicating the two first lower end slots 251 at the two ends thereof, and the first elastic band 31 is limited within the first upper transverse slot 151 and the first lower transverse slot 251. The second upper connecting portion 16 further includes a second upper transverse slot 162 for communicating the two second upper end slots 161 at the two ends thereof, the second lower connecting portion 26 further includes a second lower transverse slot 262 for communicating the two second lower end slots 261 at the two ends thereof, and the second elastic band 32 is limited within the second upper transverse slot 162 and the second lower transverse slot 262. In the above structure, addition of the first upper transverse slot 152 communicates the two first upper end slots 151 at the two ends of the first upper connecting portion 15, and addition of the first lower transverse slot 252 connects the two first lower end slots 251 at the two ends of the first lower connecting portion 25. Such configuration allows the first upper connecting portion 15 and the first lower connecting portion 25 to form a dual restraint on the first elastic band 31, thereby preventing the first elastic band 31 from disengaging. Similarly, addition of the second upper transverse slot 162 and the second lower transverse slot 262 allows the second upper connecting portion 16 and the second lower connecting portion 26 to form a dual restraint on the second elastic band 32, thereby preventing the second elastic band 32 from disengaging.

In some embodiments, a height of each of the two first upper end slots 151 and a height of each of the two first lower end slots 251 are not less than one-fifth of a height of the first elastic band 31. A height of each of the two second upper end slots 161 and a height of each of the two second lower end slots 261 are not less than one-fifth of a height of the second elastic band 32.

Moreover, a height of the first upper transverse slot 152 and a height of the first lower transverse slot 252 are not less than one-fifth of the height of the first elastic band 31. A height of the second upper transverse slot 162 and a height of the second lower transverse slot 262 are not less than one-fifth of the height of the second elastic band 32.

Regarding the embodiments, relevant experimental tests are conducted, with specifics as follows.

Dimensions of both the first panel 1 and the second panel 2 are 90 mm×58 mm×2.8 mm; the heights of each of the two first upper end slots 151, each of the two first lower end slots 251, each of the two second upper end slots 161, and each of the two second lower end slots 261 are all approximately 0.4 mm. The heights of the first upper transverse slot 152, the first lower transverse slot 252, the second upper transverse slot 162, and the second lower transverse slot 262 are also approximately 0.4 mm. Heights of the first elastic band 31 and the second elastic band 32 after assembly are both approximately 2 mm. With these specified parameters, the following data are obtained.

1) Without addition of the first upper transverse slot 152, the first lower transverse slot 252, the second upper transverse slot 162, and the second lower transverse slot 262, a maximum relative displacement in a horizontal direction between the first panel 1 and the second panel 2 reaches 2 mm.
2) With the addition of the first upper transverse slot 152, the first lower transverse slot 252, the second upper transverse slot 162, and the second lower transverse slot 262, the maximum relative displacement in the horizontal direction between the first panel 1 and the second panel 2 reaches 4 mm.

These results demonstrate that, in the embodiments, although the heights of the aforementioned portions being not less than one-fifth of the height of each of the elastic bands 3 can meet daily use requirements, operational error tolerance for users during use is relatively low. That is, when a significant horizontal displacement occurs between the first panel 1 and the second panel 2, the elastic bands are more prone to detach, causing the first panel 1 and the second panel 2 to separate and resulting in card loss. Clearly, the one-fifth height value is the minimum critical threshold; if it is less than this value, the novel card holder wallet would essentially fail to meet daily use requirements.

In some embodiments, the height of each of the two first upper end slots 151 and the height of each of the two first lower end slots 251 are not less than one-third of the height of the first elastic band 31. The height of each of the two second upper end slots 161 and the height of each of the two second lower end slots 261 are not less than one-third of the height of the second elastic band 32.

Moreover, the height of the first upper transverse slot 152 and the height of the first lower transverse slot 252 are not less than one-third of the height of the first elastic band 31. The height of the second upper transverse slot 162 and the height of the second lower transverse slot 262 are not less than one-third of the height of the second elastic band 32.

Regarding the embodiments, relevant experimental tests are conducted, with specifics as follows.

Dimensions of both the first panel 1 and the second panel 2 are 90 mm×58 mm×2.8 mm; the heights of each of the two first upper end slots 151, each of the two first lower end slots 251, each of the two second upper end slots 161, and each of the two second lower end slots 261 are all approximately 0.67 mm. The heights of the first upper transverse slot 152, the first lower transverse slot 252, the second upper transverse slot 162, and the second lower transverse slot 262 are also approximately 0.67 mm. The heights of the first elastic band 31 and the second elastic band 32 after assembly are both approximately 2 mm. With these specified parameters, the following data are obtained.

1) Without the addition of the first upper transverse slot 152, the first lower transverse slot 252, the second upper transverse slot 162, and the second lower transverse slot 262, the maximum relative displacement in the horizontal direction between the first panel 1 and the second panel 2 reaches 3 mm.
2) With the addition of the first upper transverse slot 152, the first lower transverse slot 252, the second upper transverse slot 162, and the second lower transverse slot 262, the maximum relative displacement in the horizontal direction between the first panel 1 and the second panel 2 reaches 7 mm.

These results demonstrate that, in the embodiments, the heights of the aforementioned portions being not less than one-third of the height of each of the elastic bands 3 meets daily use requirements while providing a certain improvement in an allowable relative displacement in the horizontal direction compared to the one-fifth height configuration. This enhances the operational error tolerance of the card novel holder wallet. However, an overall improvement effect is not particularly significant, and the elastic bands may still be relatively prone to detachment.

In some embodiments, the height of each of the two first upper end slots 151 and the height of each of the two first lower end slots 251 are not less than one-half of the height of the first elastic band 31. The height of each of the two second upper end slots 161 and the height of each of the two second lower end slots 261 are not less than one-half of the height of the second elastic band 32.

Moreover, the height of each of the two first upper end slots 152 and the height of each of the two first lower end slots 252 are not less than the height of the first elastic band 31. The height of each of the two second upper end slots 162 and the height of each of the two second lower end slots 262 are not less than the height of the second elastic band 32.

Regarding the embodiments, relevant experimental tests are conducted, with specifics as follows.

Dimensions of both the first panel 1 and the second panel 2 are 90 mm×58 mm×2.8 mm; the heights of each of the two first upper end slots 151, each of the two first lower end slots 251, each of the two second upper end slots 161, and each of the two second lower end slots 261 are all approximately 1 mm. The heights of the first upper transverse slot 152, the first lower transverse slot 252, the second upper transverse slot 162, and the second lower transverse slot 262 are also approximately 1 mm. The heights of the first elastic band 31 and the second elastic band 32 after assembly are both approximately 2 mm. With these specified parameters, the following data are obtained.

1) Without the addition of the first upper transverse slot 152, the first lower transverse slot 252, the second upper transverse slot 162, and the second lower transverse slot 262, the maximum relative displacement in the horizontal direction between the first panel 1 and the second panel 2 reaches 5 mm.
2) With the addition of the first upper transverse slot 152, the first lower transverse slot 252, the second upper transverse slot 162, and the second lower transverse slot 262, the maximum relative displacement in the horizontal direction between the first panel 1 and the second panel 2 reaches 12 mm.

These results demonstrate that, in the embodiments, where the heights of the aforementioned portions are not less than one-half of the height of each of the elastic bands 3, the allowable relative displacement in the horizontal direction is substantially increased compared to the one-fifth height configuration. This significantly improves the operational error tolerance of the novel card holder wallet, enabling the novel card holder wallet to adapt to more complex usage scenarios. Furthermore, overall structural stability and reliability of the he novel card holder wallet are enhanced, making such embodiments a preferred choice for mass production.

In some embodiments, the height of each of the two first upper end slots 151 and the height of each of the two first lower end slots 251 are not less than the height of the first elastic band 31. The height of each of the two second upper end slots 161 and the height of each of the two second lower end slots 261 are not less than the height of the second elastic band 32.

Moreover, the height of the first upper transverse slot 152 and the height of the first lower transverse slot 252 are not less than the height of the first elastic band 31. The height of the second upper transverse slot 162 and the height of the second lower transverse slot 262 are not less than the height of the second elastic band 32.

Dimensions of both the first panel 1 and the second panel 2 are 90 mm×58 mm×2.8 mm; the heights of each of the two first upper end slots 151, each of the two first lower end slots 251, each of the two second upper end slots 161, and each of the two second lower end slots 261 are all approximately 2 mm. The heights of the first upper transverse slot 152, the first lower transverse slot 252, the second upper transverse slot 162, and the second lower transverse slot 262 are also approximately 2 mm. The heights of the first elastic band 31 and the second elastic band 32 after assembly are both approximately 2 mm. With these specified parameters, the following data are obtained.

1) Without the addition of the first upper transverse slot 152, the first lower transverse slot 252, the second upper transverse slot 162, and the second lower transverse slot 262, a maximum relative displacement in the horizontal direction between the first panel 1 and the second panel 2 reaches 7 mm.
2) With the addition of the first upper transverse slot 152, the first lower transverse slot 252, the second upper transverse slot 162, and the second lower transverse slot 262, the maximum relative displacement in the horizontal direction between the first panel 1 and the second panel 2 reaches 17 mm.

These results demonstrate that, in the embodiments, where the heights of the aforementioned portions are not less than the height of each of the elastic bands 3, the allowable relative displacement in the horizontal direction is substantially increased compared to the one-fifth height configuration. This significantly improves the operational error tolerance of the novel card holder wallet, allowing the novel card holder wallet to adapt to more complex usage scenarios. Furthermore, the overall structural stability and reliability of the novel card holder wallet are enhanced, making the embodiments a preferred choice for mass production. Moreover, compared to the embodiments with the one-half height configuration, the present embodiments show improvements in structural stability, strength, and other dimensions, which is a premium version for mass production.

Furthermore, in all the embodiments above, the heights of the first elastic band 31 and the second elastic band 32 after assembly should be understood as their respective heights when assembled in corresponding end slots and transverse slots while the novel card holder wallet remains empty (namely, in an as-sold condition). The horizontal direction refers to a direction of movement along the first upper lateral edge 13. Additionally, test data provided above are obtained during experimental procedures and are for reference only. It should be noted that variances may occur in these data during actual use or subsequent testing.

Furthermore, the lateral edge of the first panel 1 further includes a third upper lateral edge and a fourth upper lateral edge, and the lateral edge of the second panel 2 further includes a third lower lateral edge and a fourth lower lateral edge. The insertion port 8 is formed between the third upper lateral edge, the fourth upper lateral edge, the third lower lateral edge, and the fourth lower lateral edge. Anti-detachment buckles 9 are arranged at the insertion port. Specifically, the third upper lateral edge and the fourth upper lateral edge are adjacent to each other, and the third lower lateral edge and the fourth lower lateral edge are adjacent to each other.

In the above structure, the anti-detachment buckles 9 are configured to prevent the cards from disengaging from the novel card holder wallet at the insertion port 8, thereby providing a better user experience.

Specifically, the anti-detachment buckles 9 are elastic buckles and are respectively arranged on at least the third upper lateral edge and the fourth upper lateral edge, and/or the third lower lateral edge and the fourth lower lateral edge. In some embodiments, the anti-detachment buckles 9 are arranged on the third upper lateral edge and the fourth upper lateral edge. In some other embodiment, the anti-detachment buckles 9 are arranged on the third lower lateral edge and the fourth lower lateral edge. Since the first panel 1 and the second panel 2 cannot achieve absolute flatness during actual production, particularly plastic panels that are prone to warping, the anti-detachment buckles 9 may be positioned closer to areas where the first elastic band 31 and the second elastic band 32 are located (where an elastic force is greater). Such configuration enables the anti-detachment buckles 9 to more effectively perform its anti-snap function, preventing an increase in a gap between the first panel 1 and the second panel 2 due to material warping, which could otherwise lead to failure of the anti-detachment buckles 9.

Specifically, each of the third upper lateral edge, the fourth upper lateral edge, the third lower lateral edge, and the fourth lower lateral edge is provided with an accommodating slot 10. Each of the anti-detachment buckles 9 includes an elastic arm 91, an elastic connecting portion 92, and a hook portion 93, each elastic connecting portion 92 is arranged at a first end of a corresponding elastic arm 9 and is connected to a side wall 101 of the accommodating slot 10 distal from an outer side of a corresponding one of the third upper lateral edge, the fourth upper lateral edge, the third lower lateral edge, and the fourth lower lateral edge, each hook portion 93 is arranged at a second end of a corresponding elastic arm 9, a retraction space 94 is provided between each elastic arm 91 and the accommodating slot 10 of a corresponding one of the third upper lateral edge, the fourth upper lateral edge, the third lower lateral edge, and the fourth lower lateral edge. Moreover, each elastic connecting portion 92 and the side wall 101 of the accommodating slot 10 distal from the outer side of the corresponding one of the third upper lateral edge, the fourth upper lateral edge, the third lower lateral edge, and the fourth lower lateral edge are integrally formed, which is simple in structure and reasonable in design.

Furthermore, an arc-shaped guiding surface 95 is provided between each hook portion 93 and a corresponding elastic arm 9. During card removal, the arc-shaped guiding surface 95 serves to guide the cards, thereby facilitating a process thereof and providing more convenient use.

One or more implementation modes are provided above in combination with specific contents, and it is not deemed that the specific implementation of the present disclosure is limited to these specifications. Any technical deductions or replacements approximate or similar to the method and structure of the present disclosure or made under the concept of the present disclosure shall fall within the scope of protection of the present disclosure.

What is claimed is:

1. A novel card holder wallet, comprising:

a first panel;

a second panel; and elastic bands;

wherein the first panel and the second panel are arranged opposite to each other;

wherein a first connecting portion is arranged at a lateral edge of the first panel, a second connecting portion is arranged at a lateral edge of the second panel, and the first connecting portion and the second connecting portion are arranged opposite to each other;

wherein the lateral edge of the first panel at least comprises a first upper lateral edge and a second upper lateral edge, the first connecting portion comprises a first upper connecting portion and a second upper connecting portion, the first upper connecting portion is arranged on the first upper lateral edge, and the second upper connecting portion is arranged on the second upper lateral edge;

wherein the lateral edge of the second panel at least comprises a first lower lateral edge and a second lower lateral edge, the second connecting portion comprises a first lower connecting portion and a second lower connecting portion, the first lower connecting portion is arranged on the first lower lateral edge, and the second lower connecting portion is arranged on the second lower lateral edge;

wherein the first upper connecting portion and the first lower connecting portion are arranged opposite to each other, and the second upper connecting portion and the second lower connecting portion are arranged opposite to each other;

wherein the elastic bands comprise a first elastic band and a second elastic band, the first elastic band is arranged around an outer surface of the first upper connecting portion and an outer surface of the first lower connecting portion, and the second elastic band is arranged around an outer surface of the second upper connecting portion and an outer surface of the second lower connecting portion, so that the first connecting portion is elastically connected to the second connecting portion;

wherein in the first panel, the first upper lateral edge and the second upper lateral edge are adjacent sides, and correspondingly, in the second panel, the first lower lateral edge and the second lower lateral edge are adjacent sides;

wherein the lateral edge of the first panel further comprises a third upper lateral edge and a fourth upper lateral edge, and the lateral edge of the second panel further comprises a third lower lateral edge and a fourth lower lateral edge;

wherein an insertion port is formed between the third upper lateral edge, the fourth upper lateral edge, the third lower lateral edge, and the fourth lower lateral edge; and anti-detachment buckles are arranged at the insertion port.

2. The novel card holder wallet according to claim 1, wherein the first connecting portion and the second connecting portion are both provided with limiting slots to respectively limit the elastic bands.

3. The novel card holder wallet according to claim 1, wherein the first upper connecting portion at least comprises two first upper end slots respectively at two ends thereof, the first lower connecting portion at least comprises two first lower end slots respectively at two ends thereof, the two first upper end slots and the two first lower end slots are arranged opposite to each other, and the first elastic band is limited within the two first upper end slots and the two first lower end slots; and the second upper connecting portion at least comprises two second upper end slots respectively at two ends thereof, the second lower connecting portion at least comprises two second lower end slots respectively at two ends thereof, the two second upper end slots and the two second lower end slots are arranged opposite to each other, and the second elastic band is limited within the two second upper end slots and the two second lower end slots.

4. The novel card holder wallet according to claim 3, wherein a height of each of the two first upper end slots and a height of each of the two first lower end slots are not less than one-fifth of a height of the first elastic band; and a height of each of the two second upper end slots and a height of each of the two second lower end slots are not less than one-fifth of a height of the second elastic band.

5. The novel card holder wallet according to claim 3, wherein a height of each of the two first upper end slots and a height of each of the two first lower end slots are not less than one-third of a height of the first elastic band; and a height of each of the two second upper end slots and a height of each of the two second lower end slots are not less than one-third of a height of the second elastic band.

6. The novel card holder wallet according to claim 3, wherein a height of each of the two first upper end slots and a height of each of the two first lower end slots are not less than one-half of a height of the first elastic band; and a height of each of the two second upper end slots and a height of each of the two second lower end slots are not less than one-half of a height of the second elastic band.

7. The novel card holder wallet according to claim 3, wherein a height of each of the two first upper end slots and a height of each of the two first lower end slots are not less than a height of the first elastic band; and a height of each of the two second upper end slots and a height of each of the two second lower end slots are not less than a height of the second elastic band.

8. The novel card holder wallet according to claim 3, wherein the first upper connecting portion further comprises a first upper transverse slot for communicating the two first upper end slots at the two ends thereof, the first lower connecting portion further comprises a first lower transverse slot for communicating the two first lower end slots at the two ends thereof, and the first elastic band is limited within the first upper transverse slot and the first lower transverse slot; and the second upper connecting portion further comprises a second upper transverse slot for communicating the two second upper end slots at the two ends thereof, the second lower connecting portion further comprises a second lower transverse slot for communicating the two second lower end slots at the two ends thereof, and the second elastic band is limited within the second upper transverse slot and the second lower transverse slot.

9. The novel card holder wallet according to claim 8, wherein a height of the first upper transverse slot and a height of the first lower transverse slot are not less than one-fifth of a height of the first elastic band; and a height of the second upper transverse slot and a height of the second lower transverse slot are not less than one-fifth of a height of the second elastic band.

10. The novel card holder wallet according to claim 8, wherein a height of the first upper transverse slot and a height of the first lower transverse slot are not less than one-third of a height of the first elastic band; and a height of the second upper transverse slot and a height of the second lower transverse slot are not less than one-third of a height of the second elastic band.

11. The novel card holder wallet according to claim 8, wherein a height of the first upper transverse slot and a height of the first lower transverse slot are not less than one-half of a height of the first elastic band; and a height of the second upper transverse slot and a height of the second lower transverse slot are not less than one-half of a height of the second elastic band.

12. The novel card holder wallet according to claim 8, wherein a height of the first upper transverse slot and a height of the first lower transverse slot are not less than a height of the first elastic band; and a height of the second upper transverse slot and a height of the second lower transverse slot are not less than a height of the second elastic band.

13. The novel card holder wallet according to claim 1, wherein the anti-detachment buckles are elastic buckles and are respectively arranged on at least the third upper lateral edge and the fourth upper lateral edge, and/or the third lower lateral edge and the fourth lower lateral edge.

14. The novel card holder wallet according to claim 13, wherein when the anti-detachment buckles are respectively arranged on the third upper lateral edge and the fourth upper lateral edge, each of the third upper lateral edge and the fourth upper lateral edge is provided with an accommodating slot; and each of the anti-detachment buckles comprises an elastic arm, an elastic connecting portion, and a hook portion, each elastic connecting portion is arranged at a first end of a corresponding elastic arm and is connected to a side wall of the accommodating slot distal from an outer side of a corresponding one of the third upper lateral edge and the fourth upper lateral edge, each hook portion is arranged at a second end of a corresponding elastic arm, a retraction space is provided between each elastic arm and the accommodating slot of a corresponding one of the third upper lateral edge and the fourth upper lateral edge.

15. The novel card holder wallet according to claim 14, wherein an arc-shaped guiding surface is provided between each hook portion and a corresponding elastic arm.

16. The novel card holder wallet according to claim 14, wherein each elastic connecting portion and the side wall of the accommodating slot distal from the outer side of the corresponding one of the third upper lateral edge and the fourth upper lateral edge are integrally formed.

17. A novel card holder wallet, comprising:

a first panel;

a second panel; and elastic bands;

wherein the first panel and the second panel are arranged opposite to each other;

wherein a first connecting portion is arranged at a lateral edge of the first panel, a second connecting portion is arranged at a lateral edge of the second panel, and the first connecting portion and the second connecting portion are arranged opposite to each other;

wherein the lateral edge of the first panel at least comprises a first upper lateral edge and a second upper lateral edge, the first connecting portion comprises a first upper connecting portion and a second upper connecting portion, the first upper connecting portion is arranged on the first upper lateral edge, and the second upper connecting portion is arranged on the second upper lateral edge;

wherein the lateral edge of the second panel at least comprises a first lower lateral edge and a second lower lateral edge, the second connecting portion comprises a first lower connecting portion and a second lower connecting portion, the first lower connecting portion is arranged on the first lower lateral edge, and the second lower connecting portion is arranged on the second lower lateral edge;

wherein the first upper connecting portion and the first lower connecting portion are arranged opposite to each other, and the second upper connecting portion and the second lower connecting portion are arranged opposite to each other;

wherein the elastic bands comprise a first elastic band and a second elastic band, the first elastic band is arranged around an outer surface of the first upper connecting portion and an outer surface of the first lower connecting portion, and the second elastic band is arranged around an outer surface of the second upper connecting portion and an outer surface of the second lower connecting portion, so that the first connecting portion is elastically connected to the second connecting portion;

wherein in the first panel, the first upper lateral edge and the second upper lateral edge are adjacent sides, and correspondingly, in the second panel, the first lower lateral edge and the second lower lateral edge are adjacent sides;

wherein the first upper connecting portion comprises two first upper end slots respectively at two ends thereof and a first upper transverse slot for communicating the two first upper end slots, the first lower connecting portion comprises two first lower end slots respectively at two ends thereof and a first lower transverse slot for communicating the two first lower end slots, the two first upper end slots and the two first lower end slots are arranged opposite to each other, and the first elastic band is limited within the first upper transverse slot and the first lower transverse slot;

wherein the second upper connecting portion comprises two second upper end slots respectively at two ends thereof and a second upper transverse slot for communicating the two second upper end slots, the second lower connecting portion comprises two second lower end slots respectively at two ends thereof and a second lower transverse slot for communicating the two second lower end slots, the two second upper end slots and the two second lower end slots are arranged opposite to each other, and the second elastic band is limited within the second upper transverse slot and the second lower transverse slot.

18. A novel card holder wallet, comprising:

a first panel;

a second panel; and elastic bands;

wherein the first panel and the second panel are arranged opposite to each other;

wherein a first connecting portion is arranged at a lateral edge of the first panel, a second connecting portion is arranged at a lateral edge of the second panel, and the first connecting portion and the second connecting portion are arranged opposite to each other;

wherein the lateral edge of the first panel at least comprises a first upper lateral edge and a second upper lateral edge, the first connecting portion comprises a first upper connecting portion and a second upper connecting portion, the first upper connecting portion is arranged on the first upper lateral edge, and the second upper connecting portion is arranged on the second upper lateral edge;

wherein the lateral edge of the second panel at least comprises a first lower lateral edge and a second lower lateral edge, the second connecting portion comprises a first lower connecting portion and a second lower connecting portion, the first lower connecting portion is arranged on the first lower lateral edge, and the second lower connecting portion is arranged on the second lower lateral edge;

wherein the first upper connecting portion and the first lower connecting portion are arranged opposite to each other, and the second upper connecting portion and the second lower connecting portion are arranged opposite to each other;

wherein the elastic bands comprise a first elastic band and a second elastic band, the first elastic band is arranged around an outer surface of the first upper connecting portion and an outer surface of the first lower connecting portion, and the second elastic band is arranged around an outer surface of the second upper connecting portion and an outer surface of the second lower connecting portion, so that the first connecting portion is elastically connected to the second connecting portion;

wherein in the first panel, the first upper lateral edge and the second upper lateral edge are adjacent sides, and correspondingly, in the second panel, the first lower lateral edge and the second lower lateral edge are adjacent sides;

wherein the first upper connecting portion at least comprises two first upper end slots respectively at two ends thereof, the first lower connecting portion at least comprises two first lower end slots respectively at two ends thereof, the second upper connecting portion at least comprises two second upper end slots respectively at two ends thereof, and the second lower connecting portion at least comprises two second lower end slots respectively at two ends thereof;

wherein the first upper connecting portion further comprises a first upper transverse slot for communicating the two first upper end slots at the two ends thereof, the first lower connecting portion further comprises a first lower transverse slot for communicating the two first lower end slots at the two ends thereof, and the first elastic band is limited within the first upper transverse slot and the first lower transverse slot;

wherein the second upper connecting portion further comprises a second upper transverse slot for communicating the two second upper end slots at the two ends thereof, the second lower connecting portion further comprises a second lower transverse slot for communicating the two second lower end slots at the two ends thereof, and the second elastic band is limited within the second upper transverse slot and the second lower transverse slot.

* * * * *